United States Patent [19]

Becker et al.

[11] 4,308,797

[45] Jan. 5, 1982

[54] APPARATUS FOR PRINTING OR APPLYING SELF-ADHESIVE LABELS

[75] Inventors: Werner Becker; Günter Holland-Letz, both of Hirschhorn; Heinrich Volk, Beerfelden, all of Fed. Rep. of Germany

[73] Assignee: Esselte Pendaflex Corporation, Garden City, N.Y.

[21] Appl. No.: 11,644

[22] Filed: Feb. 12, 1979

[30] Foreign Application Priority Data

Feb. 18, 1978 [DE] Fed. Rep. of Germany ..... 2807056

[51] Int. Cl.[3] ..... B41K 5/00

[52] U.S. Cl. ..... 101/292; 156/384; 192/12 BA

[58] Field of Search ..... 101/288, 291, 292; 156/DIG. 44, 45, 384, 385; 192/12 BA, 26; 74/125.5

[56] References Cited

U.S. PATENT DOCUMENTS

| | | | |
|---|---|---|---|
| 1,811,028 | 6/1931 | Ryan | 192/26 |
| 2,708,404 | 5/1955 | Wright | 101/288 |
| 3,000,299 | 9/1961 | Nells et al. | 101/291 |
| 3,033,417 | 5/1962 | Van Meer | 156/DIG. 44 |
| 3,096,712 | 7/1963 | Filsinger | 101/288 |
| 3,232,399 | 2/1966 | Harned et al. | 192/12 BA |
| 3,529,703 | 9/1970 | Kroeker | 192/26 |
| 3,793,114 | 2/1974 | Thomas | 156/DIG. 45 |
| 3,987,880 | 10/1976 | Holland-Letz | 192/12 BA |
| 4,053,345 | 10/1977 | Hamisch | 156/384 |
| 4,073,234 | 2/1978 | Sato | 101/292 |

FOREIGN PATENT DOCUMENTS

| | | | |
|---|---|---|---|
| 838265 | 5/1952 | Fed. Rep. of Germany . | |
| 1086261 | 10/1967 | United Kingdom | 156/DIG. 45 |

*Primary Examiner*—William Pieprz
*Attorney, Agent, or Firm*—Gerald J. Ferguson, Jr.; Joseph J. Baker

[57] ABSTRACT

A hand-held labeller for printing and/or applying self-adhesive labels which adhere as a strip or separately at equal distances on a carrier strip, the apparatus comprising a frame; a supply member mounted with respect to the frame for mounting the carrier strip and labels; a label separation member mounted with respect to the frame; a feed wheel or winding drum mounted with respect to the frame; means for guiding the carrier strip from the supply member by the label separation member and then to the feed wheel; a hand lever so pivotally mounted with respect to the frame that the lever may be pivoted by an operator's hand as the labeller is being held in the hand of an operator; coupling means for coupling the hand lever to the feed wheel to operate the feed wheel each time the hand lever is pivoted and thus advance the carrier strip from the supply member so that the labels are successively separated from the carrier strip at the label separation member and the carrier strip is incrementally wound upon the feed wheel; sensing means for sensing the advancement of the carrier strip a predetermined distance; de-coupling means for de-actuating the coupling means so that the hand lever is de-coupled from the feed wheel in response to the sensing means sensing the advancement of the carrier strip the predetermined distance and thus ensure that the feed wheel advances the carrier strip the predetermined distance each time the hand lever is actuated regardless of the amount of carrier strip wound upon the feed wheel.

24 Claims, 8 Drawing Figures

APPARATUS FOR PRINTING OR APPLYING SELF-ADHESIVE LABELS

BACKGROUND OF THE INVENTION AND DESCRIPTION OF THE PRIOR ART

The invention is concerned with an apparatus for printing and/or applying self-adhesive labels, which adhere as a strip or separately at equal spacings on a carrier strip which is formed with recesses or marginal indentations which are arranged at spacings which correspond to the spacings of the leading edges of the labels, which is equipped with a feed mechanism which pulls off the carrier strip intermittently for the feeding of a label and which, in conjunction with a device feeling the label carrier strip which is provided with projections engaging in the recesses or marginal indentations of the carrier strip, brings the labels into a printing and/or dispensing position which is to be exactly assumed.

In particular the invention concerns a novel feeding mechanism for the advancing of labels adhering to a carrier strip. Apparatuses for which the novel feeding mechanism may be employed to advantage are, for example, known from U.S. Pat. Nos. 3,265,553; 3,330,207; 3,420,172; 3,440,123; 3,551,251; 3,611,929; 3,619,324; 3,674,609; 3,852,140 and 3,911,817.

What are involved are apparatuses with which adhesive labels can be delivered or applied to articles which are to be labelled. During their travel from a feed roller to the dispensing position, it is also possible to print on the labels. These apparatuses may be constructed as apparatuses which are to be manually operated or they may even be constructed as machines which operate automatically. The labels may adhere with spacings on the carrier strip, but they may also be wholly or partially separated from one another by straight separation cuts or by a perforation. It is also possible to employ label strips which consist of a carrier strip and a paper strip adhering thereto in the form of a band. In this case, after the labels have been printed and after the detachment from the carrier strip, the individual label has to be cut off from the band.

A particular problem which arises with these apparatuses is to control the feeding mechanism acting on the carrier strip such that, with each feeding movement, a label is brought into a dispensing position which is to be accurately maintained and possibly another label is brought into a printing position which is also to be accurately maintained. With the known apparatuses, label strips are used which are provided, for the control of the feeding mechanism, with marginal notches, indentations or cut-outs, which are arranged at intervals corresponding exactly to the distance between the leading edges of the labels. These indentations or the like are explored or scanned mechanically by means of feeler members, which control the pull-off travel of the feed mechanism acting on the carrier strip.

An apparatus for delivering labels is known from U.S. Pat. No. 3,611,929, in which the labels adhere individually and in a row on a carrier strip, which is formed with recesses or marginal indentations which are arranged at intervals which correspond to the distances between the leading edges of the labels, and which is characterized in that a feed roller which can be driven intermittently always by equal angles, is provided on its circumference and in an angular division corresponding to the feeding angle with projections which engage with play in the recesses or marginal indentations of the carrier strip and, in order to produce a sufficiently large frictional force between the carrier strip and the feed roller, the latter is embraced by the carrier strip by an angle which is larger than 120°.

This known apparatus has the disadvantage that the tensile force exerted by the feeding or conveying wheel on the label strip is dependent on the frictional forces between the carrier strip and the said roller. These frictional forces may, for example, be greatly reduced by the surface of the feed roller becoming soiled.

This apparatus and all known labelling apparatuses to be manually operated have the additional disadvantage that the empty label-carrying strip is guided out of the apparatus and the end of the strip, after each brief use of the apparatus, has to be torn off, so that it is not in the way.

In order to avoid this last mentioned disadvantage, it is known in connection with electrically driven labelling machines, for example, from U.S. Pat. No. 3,033,417, Van Meer, and U.S. Pat. No. 3,436,294, Marano, to wind the carrier strip for the labels on to a winding drum which can be driven by an electric motor, which is switched on and off by a feeler member which optically or mechanically scans the label strip.

These machines have the disadvantage that they require a source of electrical energy and consequently are unsuitable for apparatuses to be operated manually. A battery and also a conductor for connection to the mains are very inconvenient for labelling apparatuses which are to be manually operated.

Finally, a label-issuing apparatus which is manually operated is known from the German Pat. No. 838,165, with which self-adhesive labels adhering to a carrier strip are individually delivered. The feeding of the labels is effected by means of a winding drum by which the carrier strip freed from labels is wound on step by step. The winding drum is intermittently driven by way of a freewheel clutch, which couples a driving lever in the driving direction to the winding drum. It is not possible with this arrangement to maintain accurately a quite specific feeding distance of the labels, because even with a rocking angle of the driving lever remaining the same, the respective advance of the labels would not be constant, because the feeding distance of the labels is increased as the convolutions of the strip on the winding drum become larger. This feeding mechanism is unsuitable for a labelling apparatus with which the labels have to assume quite an accurate printing position and also an accurate dispensing position.

SUMMARY

The object of the invention is to provide a feeding mechanism for the intermittent advance of a label carrier strip which does not show the disadvantages of the known arrangements and which permits a reliable feeding of the labels with an accurate advance by mechanical means, using a winding drum as known per se. More particularly, the arrangement for feeling or scanning the label strip is in this case to operate reliably and to provide strong forces for exact control of the feeding of the labels. Finally, the new mechanism is to be designed such that it is possible in a simple manner to introduce a label strip without any interference and to fix the empty or bare carrier strip on the winding drum.

Starting from the apparatus as described in the preamble of claim 1, this object is achieved according to the invention by the fact that the feed mechanism comprises a winding drum which winds up the carrier strip and is provided with a non-reverse stop or lock, said drum being capable of being driven by a freewheel clutch controlled by the feeler device through such angles of rotation that the section of the carrier strip which is wound on by the winding drum always corresponds to the explored or scanned distances A.

The apparatus according to the invention, which is more particularly designed as a hand-labelling apparatus, has the advantage that an empty carrier strip no longer emerges from the apparatus and as a consequence no interfering end of the strip has to be regularly torn off while the apparatus is in operation.

The apparatus according to the invention has the additional advantage that no parts which cause the transporting or feeding of the label strip come into contact with a surface of the carrier strip to which particles of adhesive are still attached. With known apparatuses, disruptions are frequently caused by the fact that the feed roller acting on the label carrier strip or a feeding slide member acting on the carrier strip, after having been used for a relatively long time, have particles of adhesive attached thereto, so that a precise feeding action with accurate registry is no longer guaranteed.

With the apparatus according to the invention, the feeding of the labels, even after the apparatus has been in use for several years, always corresponds to the label spacing, so that it is possible to have a precise printing of the labels and to maintain a quite accurate dispensing position of the printed label.

The labelling apparatus has a hand lever which can be swung relatively to a handle and which is coupled to both the label-printing arrangement and the label-feeding mechanism. The invention is advantageously employed in connection with a labelling apparatus which corresponds to U.S. Pat. No. 3,911,817, Becker et al, and in which the printing mechanism is fixed on a printing mechanism lever which is coupled via a compression spring to the hand lever such that, first of all, with the inward swinging of the hand lever, the compression spring is tensioned and thereafter the printing mechanism lever is freed by a latch or the like and is swung by the tensioned compression spring with the printing mechanism towards the printing table or plate.

The controllable freewheel clutch preferably comprises a control cage which, via an engageable clutch which can be so engaged that, with said clutch closed, a coupling is produced between a driving boss and a driven boss, whereas with said clutch open, the control cage cancels the coupling between the driving boss and the driven boss. More especially a friction clutch is suitable as engageable clutch. Controllable freewheel clutches can be equipped with clamping rollers which can be brought by the control cage into a coupling position or into a free-wheeling position, or are even fitted with a looped spring.

More especially suitable as a freewheel clutch is an arrangement such as that known from U.S. Pat. No. 3,987,880. With this arrangement, a coupling is produced between a driving boss and a driven boss by means of a looped spring, the diameter of which can be changed by a control cage connected to the looped spring. For example, if the control cage is held by means of a friction clutch or slipping clutch and as a result the looped spring is loaded, then this latter spring couples the driving boss to the driven boss. If the control cage is freed, then the looped spring is relieved of load, so that there is a change in its diameter and the coupling between the driving boss and the driven boss no longer exists. With this arrangement, a non-reverse stop or lock of the driving boss is also formed by a looped spring. The said spring opens up when the driven boss is rotated in the winding direction and is closed as soon as this said driven boss is rotated contrary to the winding direction.

The controllable freewheel clutch with a non-reverse stop, as known per se, is particularly suitable for the hand-labelling apparatus in accordance with the invention, because it is light in weight, takes up little space and can be arranged inside the winding drum.

In order to achieve a completely safe operational control, the controllable freewheel clutch is coupled to a swivelable feeler finger which is displaceable in the feeding direction of the label carrier strip and which comprises at least one projection which can drop into the recesses or indentations of a carrier strip. The coupling of the feeler finger with the control cage of the freewheel clutch is such that, when the driving boss is driven in the driving direction, the said driving boss is coupled to the driven boss until the projection of the feeler finger drops into the label strip and the said finger is displaced by the label strip in the feeding direction. This movement of the feeler finger in the feeding direction of the label strip causes an opening of the coupling between the driving boss and driven boss.

Other features of the invention will become apparent from the claims.

BRIEF DESCRIPTION OF THE DRAWINGS

In the following description one constructional example of a labelling apparatus according to the invention which is to be manually operated is more fully explained by reference to the drawings, wherein.

DETAILED DESCRIPTION OF THE INVENTION

Figure 1:
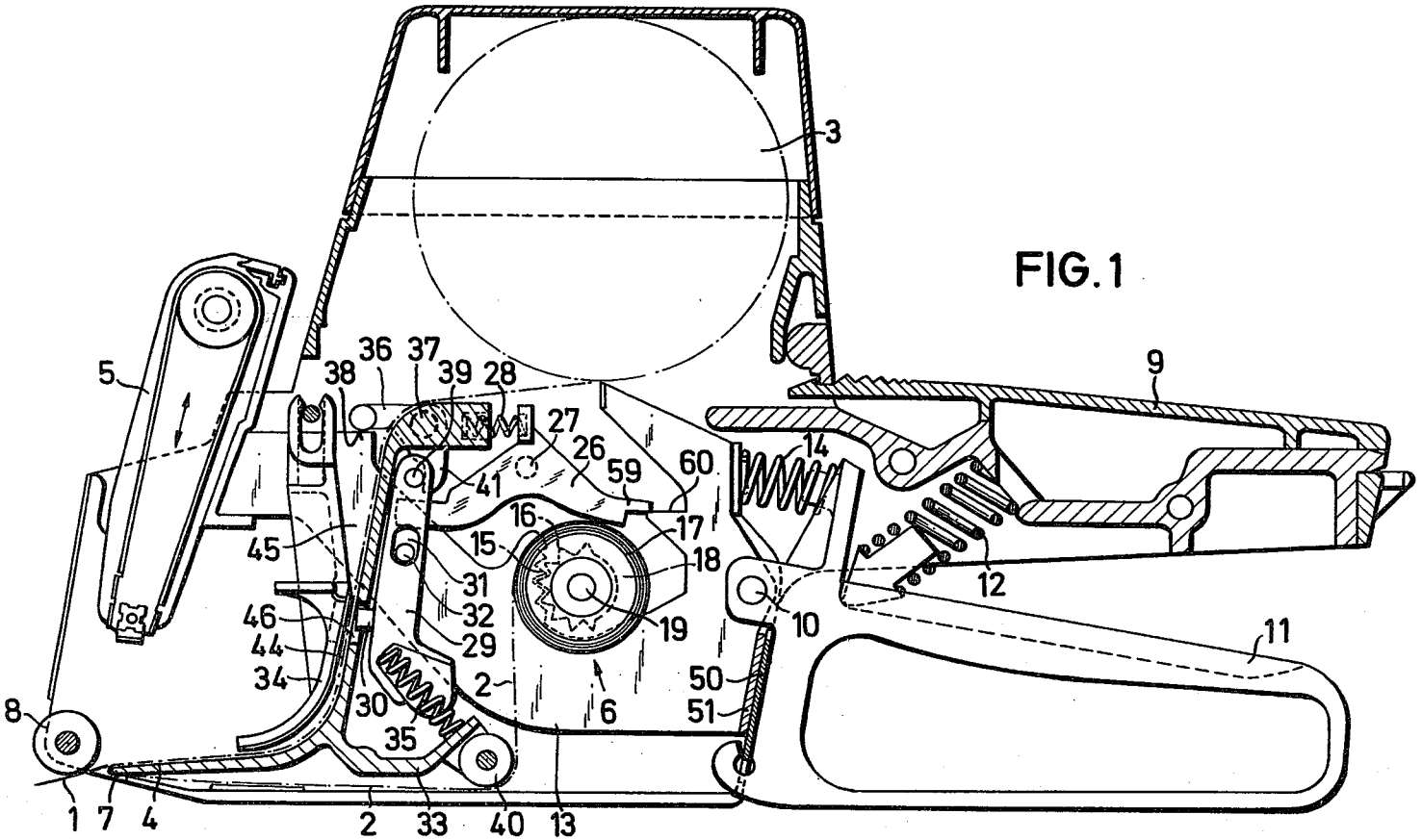
FIG. 1 is a side elevation of a labelling apparatus with the label feeding mechanism according to the invention, partly in section.

Using the apparatus as illustrated in FIG. 1, self-adhesive labels 1, which adhere in a row to a carrier strip 2, are printed as they travel from the label-supply roller to the label-delivery position by a printing mechanism 5 which is capable of being moved against the printing table or plate 4 and the carrier strip 2, for the detachment of the labels 1, is pulled stepwise around a deflecting device 7 by a feed mechanism 6 which can be rotated intermittently. The deflecting device 7 may be formed by a rounded edge or a roller which is of small diameter. At the deflecting device 7, the carrier strip 2 is deflected through approximately 180°, so that the self-adhesive labels, due to their rigidity, are detached from the carrier strip 2 and reach the dispensing position. A printed label 1 which is for the major part detached from the carrier strip 2 and is disposed in the dispensing position is still lightly held at its trailing edge, while it is disposed with its leading edge beneath a pressure-applying roller 8 or another pressure-applying device, with which it can be rolled on to an article which is to be labelled.

Those parts of the apparatus which are necessary for the printing of the labels and also for the intermittent feeding of the labels are arranged in a housing which comprises a handle 9, against which it is possible for a hand lever 11 pivotable on the housing about the pivot 10 to be swung against the force of a return spring 12. As a result of the inward swinging of the hand lever 11, the printing mechanism 5, which is fixed on a printing mechanism lever 13 pivotable about the pivot 10 and coupled by way of a compression spring 14 to the hand lever 11, is moved towards the printing plate 4. Provided on the printing mechanism lever 13 is a rack 15, which meshes with a pinion 16 by which the feed mechanism 6 is intermittently driven.

The feed mechanism 6 by which the carrier strip 2 carrying the labels is pulled off step by step consists of a winding drum 17 which winds up the empty carrier strip 2. Arranged between the pinion 16 and the winding drum 17 is a freewheel clutch 18, by which it is ensured that the pinion 16 runs freely in one direction of movement of the rack 15, whereas in the other direction of movement of the rack 15, the pinion 16 is coupled to the winding drum 17 and rotates the latter by a specific amount. The coupling of the pinion 16 with the winding drum 17 and hence the feeding of the labels may take place when the printing mechanism lever 13 is swung against the printing plate 4 by compression spring 14 which is tensioned by swinging in the hand lever 11 or, as shown by the constructional example, when the printing mechanism lever 13 is swung by the return spring 12 through the hand lever 11 and the stop surfaces 50,51 into the starting position.

With the pivoting of the hand lever 11 of the apparatus which is illustrated in FIG. 1, the return spring 12 and the compression spring 14 are tensioned. At the same time, by means of an arrangement which is not illustrated, an inking device which is not shown and which inks the printing mechanism 5 is swivelled in such a way that the path of movement of the printing mechanism 5 towards the printing plate 4 is free. At the end of the pivotal movement of the hand lever 11, the printing mechanism 13 is released by a latch (not shown), so that the spring 14 presses the printing mechanism 5 against the printing plate 4. At this time, the rack 15 is moved downwards and the pinion 16 is rotated counter-clockwise. Thereby the freewheel clutch 18 arranged between the pinion 16 and the winding drum 17 runs freely. The winding drum 17 is at this time held in its position by a non-reverse stop or lock.

When the hand lever 11 is released, the following takes place: The return spring 12 forces the hand lever 11 back into its starting position. Simultaneously, the printing mechanism lever 13, bearing with the surface 51 against the abutment surface 50 of the hand lever 11, is forced back into its initial position. The rack 15 then rotates the pinion 16 coupled to the winding drum 17 in a clockwise direction and the carrier strip 2 guided by the deflecting device 7 by means of the deflecting roller 40 and fixed at its end to the winding drum 17, is pulled off by a certain amount corresponding to the spacings of the labels and wound on to the drum 17.

Because the coil diameter varies with the number of turns of the carrier strip wound on, the rotational angle of the winding drum 17 must be all the smaller, the larger is the diameter of the strip coil already wound. For this reason, the coupling phase of the freewheel clutch 18 is controlled dependent on the spacings A with which the labels 1 adhere to the carrier strip 2. A control latch 26 and a feeler finger 29 exploring the label strip 2 serve to control the coupling phase of the freewheel clutch 18.

Figure 2:
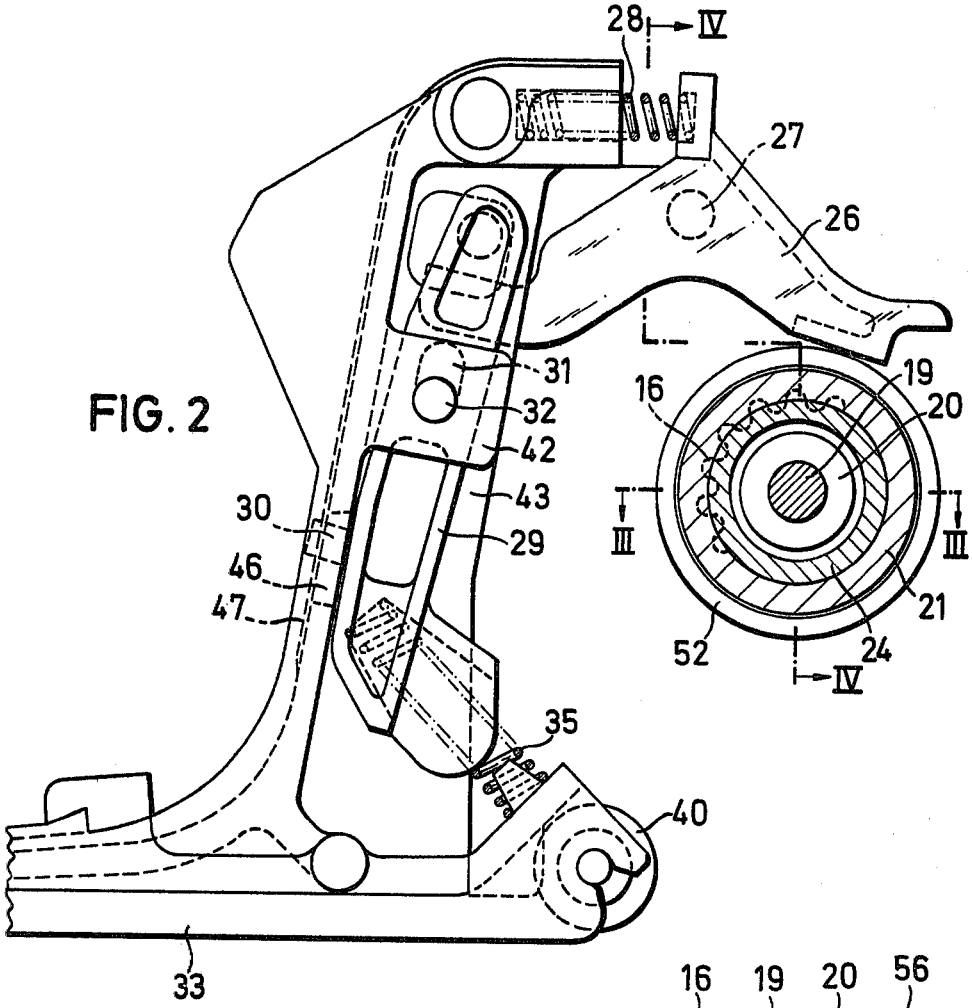
FIG. 2 is a side elevation of the feeding mechanism to a larger scale, the freewheel clutch being sectioned in accordance with the section lines II—II in FIG. 3.
Figure 3:
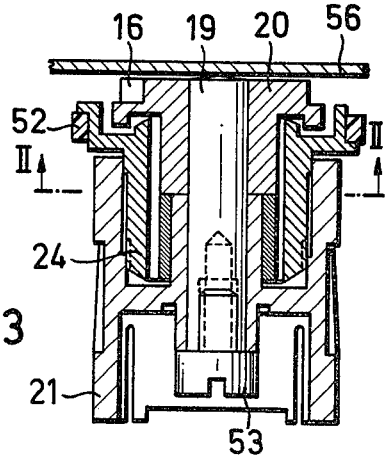
FIG. 3 is an elevation along the section line III—III in FIG. 2 of the driving boss, the driven boss and the control cage.

As will be more particularly seen from FIGS. 2 and 3, the pinion 16 is formed as a gear segment and is connected to a driving boss 20. The driving boss 20 is mounted on a journal 19, on which the driven boss 21 is also mounted.

Figure 4:
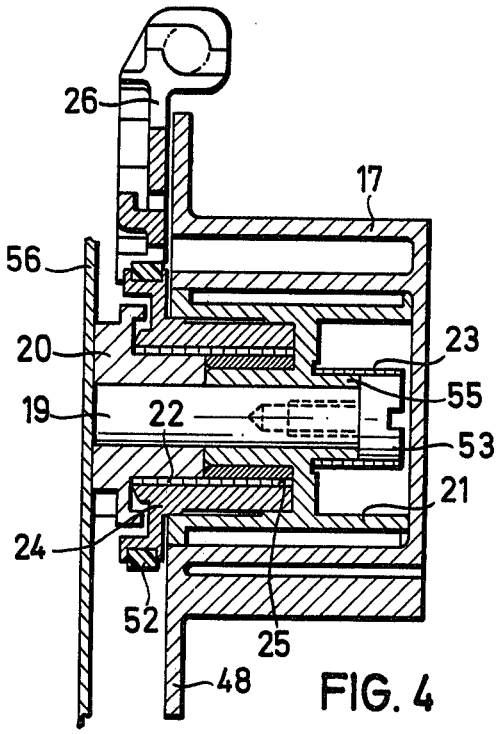
FIG. 4 is an elevation along the section line IV—IV in FIG. 2.

It is seen from FIG. 4 that the driven boss 21 carries the winding or take-up drum 17. The journal 19 fixed on the housing, the driving boss 20, the driven boss 21, the controllable freewheel clutch formed by a looped spring 22, the non-reverse stop which is likewise formed by a looped spring 23, as well as a control cage 24, are substantially arranged inside the winding of take-up drum 17.

The driving boss 20 is connected to the looped spring 22, whereof the unloaded diameter is larger than the diameter of the cylindrical part 25 of the driven boss 21 which cooperates with the said spring 22 and the free end of which is held by a control cage 24 which surrounds the said spring 22. A control latch 26 is operative on the circumference of that part of the control cage 24 which projects from the winding or take-up drum 17, said latch being pivotable about the pivot 27 and under the action of a compression spring 28. In order to produce a good frictional contact between the control cage 24 and the control latch 26, a friction ring 52 is arranged on the circumference of the said cage 24.

The control latch 26 is operative in such a manner on the control cage 24 that, with rotation of the driving boss 20 and the looped spring 22 which is connected therewith in the driving direction, the said spring 22 is loaded and as a consequence becomes smaller in diameter and immediately produces a coupling with the driven boss 21. If the control latch 26 is lifted out of the control cage 24, then the spring 22 is detensioned in such a manner that its diameter becomes larger and the coupling between driving boss 20 and driven boss 21 is broken. The looped spring 22 then only produces a coupling between the driving boss 20 and the driven boss 21 when the said driving boss 20 is rotated in the driving direction, which is the clockwise direction as shown in FIG. 1, and the control cage 24 is loaded by the control latch 26. The change of the diameter of the looped spring 22 is very small. For that reason there is no space to be seen in the drawing between the looped spring 22 and the surrounding control cage 24. The thickness of this space lies within the breadth of the lines of the drawing.

According to FIG. 2, the control latch 26 is held by the compression spring 28 so as to bear against the friction ring 52. In this position, the driving boss 20 is coupled to the driven boss 21 in the winding-up direction. A feeler finger 29 serves to break this coupling at the correct time. The said finger 29 comprises feeling projections 30 which drop into the recesses or indentations 54 of the label carrier strip 2 while the labels 1 are being fed or transported. The feeler finger 29 comprises a slot 31, through which a bolt 32 engages which is fixed in a bearing block 33. As shown in FIG. 2, the bolt 32 is held in two lateral walls 42,43 of the bearing block. Between the said lateral walls 42,43, the feeler finger 29 is pivotable about the bolt 32 and is guided in its longitudinal direction parallel to the guiding slot 44, in which the carrier strip provided with labels is guided. The guiding slot 44 is formed by the front surface of the bearing block 33 and the rear surface of a strip-guiding flap 34. Those surfaces of the bearing block 33 and of the strip-guiding flap 34 which correspond to one another are so formed that, above the guiding slot 44, they form a strip inlet narrowing in funnel-like manner. This constructional form facilitates the introduction of the label strip. In the front region of the guiding slot 44, openings 46 are provided in the walls of the bearing block 33 and of the strip-guiding flap 34, which form the guiding slot 44, through which openings the projections 30 of the feeler finger 29 can pass and can be displaced by approximately half a label spacing parallel to the guiding slot 44.

The feeler finger 29 is under the action of a pressure-applying spring 35, which firstly presses the feeler finger 29 with the feeler projections 30 against the label strip guided in the guiding slot 44 and secondly forces the feeler finger 29 upwards into its initial position. The initial position of the said finger 29 is shown in FIG. 1. In this position, the projections 30 bear against the carrier strip for the labels. If now the label strip is displaced in the feeding direction in the guiding slot 44, then the projections 30 drop into the indentations of the label strip and the feeler finger 29 is carried along in the feeding direction, against the action of the spring 35, until the stop bolt or pin 39 on the feeler finger 29 presses against the control latch 26 and swivels the latter about the pivot 27 against the action of the spring 28 and is thereby lifted from the control cage. By the lifting of the control latch 26 the coupling between driving boss 20 and driven boss 21 is broken and the feeding of the labels is immediately interrupted. At this instant, a printed label 1 is disposed in the dispensing position. At the end of the upward swinging movement of the printing mechanism lever 13, an abutment surface 38 of this lever 13 strikes against a lifting device 36, which is pivotable about the pivot 37. As a result, a lever arm 41 of the lifting device 36 which bears against the feeler finger 29 applies pressure to the upper end of the said finger 29 and pivots the latter about the pivot 32 in a counter-clockwise direction, so that the projections 30 are withdrawn from the guiding slot 44 and from the indentations of the label carrier strip 2, so that the spring 35 can force the said finger 29 upwards into the initial position which is shown in FIG. 1.

It has been shown that a particularly reliable control of the feeding of the labels is obtained by the fact that the carrier strip comprises recesses or indentations 54 at intervals A on both its margins, each of which recesses or indentations is engaged by a projection 30, said projections being arranged for example on both sides of the feeler finger 29. The projections 30 engage through openings 46, which are arranged in walls which form the guiding slot 44.

Figure 6:
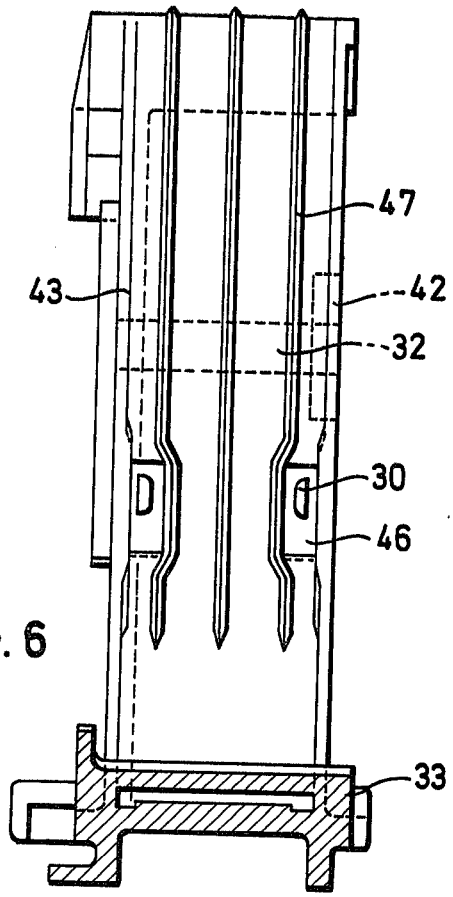
FIG. 6 is a front elevation of the front surface of the bearing block.
Figure 7:
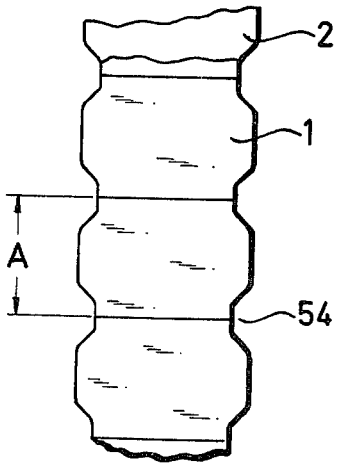
FIG. 7 is a plan view of a portion of a label strip.

As shown in FIGS. 2 and 6, the front surface of the bearing block 33 has arranged thereon narrow guiding ribs 47 on which the rear side of the carrier strip slides. Corresponding ribs are also arranged on the guiding surface of the strip-guiding flap 34. As shown in FIG. 1, the strip-guiding flap 34 is shaped in the upper region such that an inlet 45 tapering in funnel-like manner is formed, this permitting a convenient introduction of the label strip.

Figure 5:
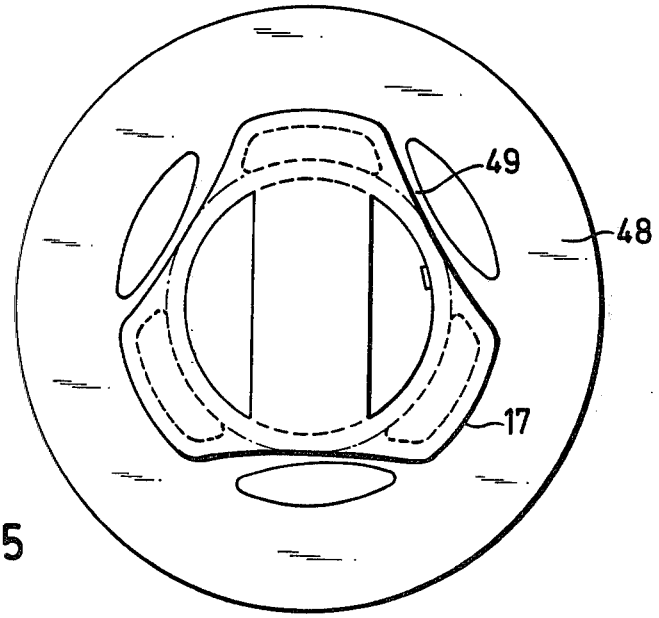
FIG. 5 is a side elevation of the winding drum.
Figure 8:
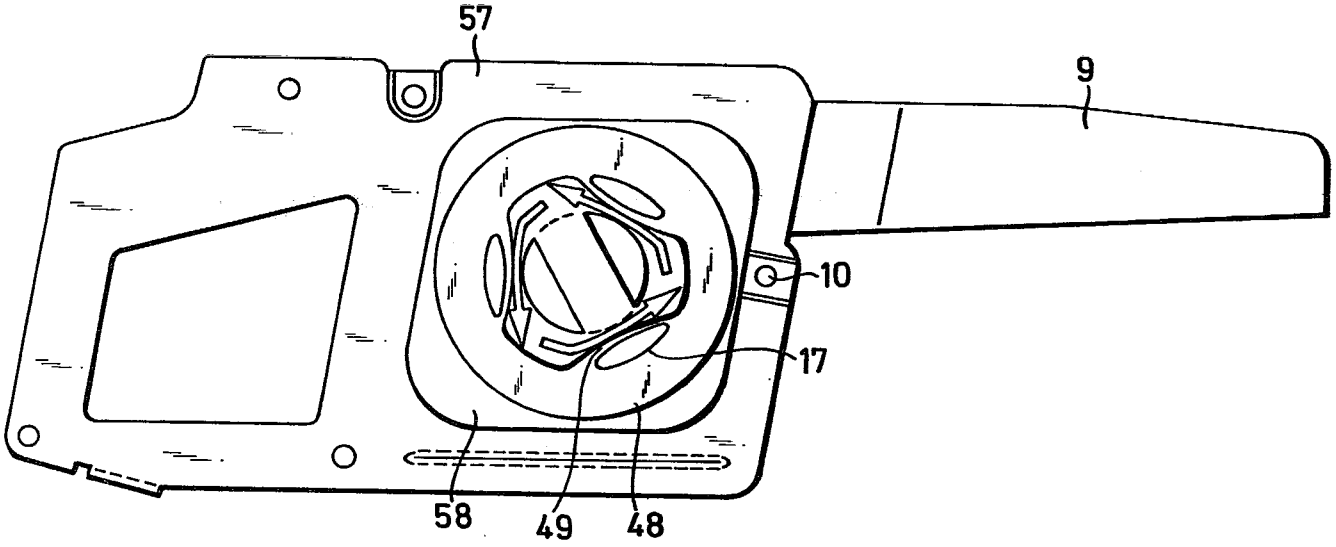
FIG. 8 is a side elevation of the non-supporting side wall of the housing.

As shown in FIGS. 4, 5 and 8, in order that the empty carrier strip 2 may be easily fixed at its end to the winding or take-up drum 17, said drum is formed with insertion slots 49 which are open laterally and into which the leading end of the empty carrier strip can be inserted. As indicated by arrows in FIG. 8, the leading end of the empty carrier strip 2 is inserted contrary to the winding direction into the slots 49, so that already the initial region of the first convolution bears on the inserted leading end of the strip and clamps the said region between itself and the drum 17. In order to introduce the leading end of the carrier strip easily, the slots 49 are enlarged on the insertion side in a funnel-like manner. The wound or coiled convolution of carrier strip can be pulled off laterally from this winding or take-up drum 17. For convenient withdrawal of the carrier strip convolution or of the winding drum 17, a relatively large opening 58 is formed in the non-supporting wall 57 of the housing, as shown in FIG. 8, through which the take-up drum 17 can be detached from the driven boss 21.

As shown in FIG. 1, the control latch 26 comprises a nose or projection 59, which cooperates with a stop or abutment 60 which is on the printing mechanism lever 13. The action of the abutment 60 is that the control latch 26 remains in the open position, even when the lifting device 36 has swung the feeler finger 29 out of its engagement with the label strip. What is hereby prevented is that the feeding of the labels is once again initiated, after the feeler finger has reached its initial position, for example, due to inaccuracies in dimensions. The abutment 60 may be arranged in such a manner that it already lifts the control latch 26 before the abutment 38 actuates the lifting member 36. The result hereby achieved is that the feeler finger 29 is relieved of the pressure of the spring 28 when said finger 29 is disengaged from the label strip.

What we claim is:

1. In a hand-held labeller for printing and/or applying self-adhesive labels, which adhere as a strip or separately at equal spacings on a carrier strip which is formed with recesses or marginal indentations which are arranged at spacings which correspond to the spacings of the leading edges of the labels, equipped with a feed mechanism which pulls the carrier strip intermittently for the feeding of a label and a feeler device for feeling the label carrier strip, said feeler device including projections for engaging the recesses or marginal indentations of the carrier strip to sense advancement of the labels a predetermined distance to a printing and/or dispensing position which is to be exactly assumed, the improvement where the feed mechanism comprises a winding drum for winding up the carrier strip, the drum including a non-reverse stop, and means for driving said drum including a freewheel clutch controlled by the feeler device through such an angle of rotation that the section of the carrier strip wound on the winding drum always corresponds to the predetermined distance regardless of the amount of carrier strip wound on the winding drum.

2. An apparatus according to claims 1 characterized in that the controllable freewheel clutch comprises a control cage which can be engaged through a friction ring and which, under loading or unloading, produces a coupling between a driving boss and a driven boss which is connected to the winding drum.

3. An apparatus according to claims 1 characterized in that the freewheel clutch is a friction clutch.

4. An apparatus according to claim 2 characterized in that the freewheel clutch is formed by a looped spring which is arranged on the driving boss and is wrapped around a cylindrical part of the driven boss the free end of which is connected to the control cage.

5. An apparatus according to claim 2 characterized in that the driven boss is mounted on a journal which is fixed at one end and the winding drum fitted on to the driven boss from the side opposite the fixing of the journal.

6. An apparatus according to claim 5, characterized in that the driven boss is held by a screw which is screwed on to the free end of the journal, a looped spring acting as the non-reverse stop and engaging over a cylindrical part of the driven boss being arranged around the cylindrical head of said screw.

7. An apparatus according to claim 6 characterized in that the journal with the screw, the driving boss, the driven boss, the looped spring and the control cage are arranged substantially inside the boss or hub of the winding drum.

8. An apparatus according to claim 7, characterized in that the winding drum comprises a circular side wall on the side facing the fixing means of the journal.

9. An apparatus according to claim 2 characterized in that the controllable freewheel clutch has coupled thereto said feeler device which comprises a swivelable feeler finger which is displaceable in the feeding direction of the label carrier strip, said finger comprising at least one projection which is held resiliently bearing against the carrier strip and can drop into the recesses or indentations of the carrier strip and, by being carried along in the feeding direction of the label carrier strip, frees the coupling caused by the freewheel clutch.

10. An apparatus according to claim 9, characterized in that the feeler finger is loaded by a spring which holds the said finger in the initial or starting position and also holds the stop bearing against the said carrier strip.

11. An apparatus according to claim 9 characterized in that the driving boss is connected to a pinion which meshes with a rack which is arranged on a printing mechanism lever causing the printing of the labels.

12. An apparatus according to claim 11, characterized in that the printing mechanism lever co-operates by way of an abutment surface with a lifting device which swings the feeler finger such that the projection is withdrawn from the recess in the carrier strip when the printing mechanism lever reaches its initial position.

13. An apparatus according to claim 11 characterized in that a control latch or cam is arranged between the feeler finger and the control cage, said latch or cam being held by a spring in abutment with the control cage and swung by the feeler finger into the opening position.

14. An apparatus according to claim 13, characterized in that a friction ring is arranged on that periphery of the control cage which coacts with the control latch, said friction ring consisting of a material causing a good frictional connection.

15. An apparatus according to claim 13 characterized by a stop or abutment which co-operates with the control latch and, in the initial position of the printing mechanism lever holds the control latch in the open position.

16. An apparatus according to claims 1 characterized in that the winding drum includes a side wall disposed on the side of a supporting housing wall and a plurality of insertion slots which are open on the side further from the side wall.

17. An apparatus according to claim 16 characterized in that a non-supporting housing wall for the wind-up drum includes a large opening which makes possible the extraction of the winding drum.

18. A hand-held labeller for printing and/or applying self-adhesive labels which adhere as a strip or separately at equal distances on a carrier strip, said apparatus comprising a frame;

a supply member mounted with respect to said frame for mounting said carrier strip and labels;

a label separation member mounted with respect to said frame;

a feed wheel mounted with respect to said frame;

means for guiding said carrier strip from said supply member by said label separation member and then to said feed wheel;

a hand lever so pivotally mounted with respect to said frame that the lever may be pivoted by an operator's hand as the labeller is being held in the hand of an operator;

coupling means for coupling said hand lever to said feed wheel to operate the feed wheel each time the hand lever is pivoted and thus advance the carrier strip from the supply member so that the labels are successively separated from the carrier strip at the label separation member and the carrier strip is incrementally wound upon the feed wheel;

sensing means for sensing the advancement of said carrier strip a predetermined distance;

de-coupling means for de-actuating said coupling means so that said hand lever is de-coupled from said feed wheel in response to said sensing means sensing the advancement of the carrier strip said predetermined distance and thus ensure that the feed wheel advances the carrier strip said predetermined distance each time the hand lever is actuated regardless of the amount of carrier strip wound upon said feed wheel.

19. A hand-held labeller as in claim 18 where the axis of rotation of the feed wheel is fixed with respect to said frame so that said de-coupling means causes the angle through which the feed wheel rotates each time the hand lever is actuated to gradually decrease as the amount of carrier strip wound on the feed wheel increases.

20. A hand-held labeller as in claim 19 where said coupling means includes a clutch having a driving member responsive to said hand lever and a driven member responsive to said driving member and connected to the feed wheel and where said de-coupling means includes means for de-coupling said driving member from said driven member.

21. A hand-held labeller as in claim 20 where said clutch comprises a freewheel clutch.

22. A hand-held labeller as in claim 20 where said feed wheel is provided with a non-reverse stop.

23. A hand-held labeller as in claims 18 or 19 where said carrier strip includes regularly spaced marginal recesses in the edge of the strip, the spacing of which corresponds to said predetermined distance which, in turn, corresponds to the spacing of the leading edges of the labels on the carrier strip and where said sensing means includes a feeler which engages the edge of the strip and where said de-coupling means is responsive to said feeler sensing the spacing of the marginal recesses to de-couple the hand lever from the feed wheel.

24. A hand-held labeller as in claims 18 or 19 including a printing member responsive to said hand lever for printing a predetermined label each time the hand lever is actuated.

* * * * *